US008422689B2

(12) United States Patent
Yeh et al.

(10) Patent No.: US 8,422,689 B2
(45) Date of Patent: Apr. 16, 2013

(54) SYSTEM, APPARATUS, AND METHOD OF SPEAKER

(75) Inventors: Neng-Wen Yeh, Taipei Hsien (TW); Po-Yu Li, Taipei Hsien (TW); Ruey-Ching Shyu, Taipei Hsien (TW); Lai-Shi Huang, Taipei Hsien (TW)

(73) Assignee: Acer Incorporated, Taipei Hsien (TW)

( * ) Notice: Subject to any disclaimer, the term of this patent is extended or adjusted under 35 U.S.C. 154(b) by 904 days.

(21) Appl. No.: 12/314,128

(22) Filed: Dec. 4, 2008

(65) Prior Publication Data

US 2009/0252340 A1 Oct. 8, 2009

(30) Foreign Application Priority Data

Jul. 4, 2008 (TW) ..... 97125189 A

(51) Int. Cl.
*H04R 5/00* (2006.01)

(52) U.S. Cl.
USPC ..... 381/23; 381/17; 381/18; 704/E19.005

(58) Field of Classification Search ..... 381/17, 381/18, 23; 704/E19.005
See application file for complete search history.

(56) References Cited

U.S. PATENT DOCUMENTS 4,764,960 A 8/1988 Aoki et al.
5,598,480 A * 1/1997 Kim ..... 381/99
6,167,140 A * 12/2000 Watanabe ..... 381/123
6,813,528 B1 11/2004 Yang
2003/0016830 A1* 1/2003 Nakamichi ..... 381/18
2004/0046680 A1* 3/2004 Masuda et al. ..... 341/143
2009/0279721 A1 11/2009 Tanaka

FOREIGN PATENT DOCUMENTS

JP 2007-282011 10/2007

OTHER PUBLICATIONS

Office Action, issued from Taiwan, Republic of China Patent Office, in counterpart Taiwanese Patent Application No. 097125189 dated May 22, 2012, pp. 1-9.

* cited by examiner

*Primary Examiner* — Lynne Gurley
*Assistant Examiner* — Vernon P Webb
(74) *Attorney, Agent, or Firm* — Stites & Harbison PLLC; Juan Carlos A. Marquez

(57) ABSTRACT

A system, and an apparatus of speaker, and a method for forming a virtual audio is provided. An audio source is processed by a second audio source processing program according to parameters which are entered by the user, and filtered to be a high frequency audio signal. The audio source with orientation is outputted by the orientation speaker.

19 Claims, 4 Drawing Sheets

SYSTEM, APPARATUS, AND METHOD OF SPEAKER

CROSS REFERENCE RELATED APPLICATION

This application claims the right of priority based on Taiwan Patent Application No. 097125189 entitled "A SYSTEM, AN APPARATUS, AND A METHOD OF SPEAKER", filed on Jul. 4, 2008, which is incorporated herein by reference and assigned to the assignee herein.

FIELD OF THE INVENTION

The present invention is related to a system, an apparatus, and a method of speaker, especially to a system, an apparatus, and a method of speaker with the left and right audio channels respectively having a left and a right orientation speakers to output the orientation source signals, and the surrounding audio effect is enhanced.

BACKGROUND OF THE INVENTION

Due to the spatial limitation of the conventional portable devices, there are only two or three speaker units accommodated in the speaker. With the improving of the audio device, the 5.1 surrounding sounds are provided in many multimedia data. The audio signal is computed by the signal processor. Then, the multi-channel source is converted into the stereo audio. The users can hear the surrounding audio effect by processing the adjusted frequency and the adjusted phase of the data. However, due to the volume limitation of the product, the distance of the left audio channel and the right audio channel speaker are too close to simulate the ideal sound effect.

The conventional methods, such as the Dolby Virtual Speaker technology and the Speaker Array technology are processed the audio source. The simulated surrounding audio effect is computed by the software in a few speaker units located in the same direction to the user. However, the prior art can only simulate the sound with limited effect. The user or the manufacturer can't set the speaker units according to the current situation of the speaker and the relative position between the two speaker units when the relative position between the speaker and the reflecting object or the relative position between the two channels speakers change.

Accordingly, there is a need to provide a speaker system, device and method to resolve the above-mentioned problems.

SUMMARY OF THE INVENTION

To solve the above-mentioned problems, the present invention provides a speaker system, a device and a method for improving the surrounding audio effect by respectively accommodating two orientation speaker units on left and right audio channel to output the orientation audio source.

One aspect of the present invention provides a speaker system, comprising: a source encoder/decoder for receiving an audio signal, performing a first audio source processing program and an encoding/decoding process on the audio signal to output a first signal and a second signal, and performing a second audio source processing program and the encoding/decoding process on the audio signal to output a third signal and a fourth signal; a first main audio speaker unit and a second main audio speaker unit, for receiving the first signal and the second signal respectively; and a first orientation speaker unit and a second orientation speaker unit, for receiving the third signal and the fourth signal respectively; wherein the audio signal is processed by the source encoder/decoder to perform the second audio source processing program according to an inputting parameter.

Another aspect of the present invention provides a speaker device, comprising: at least a main audio speaker unit configured to receive a first audio signal; at least an orientation speaker unit configured to receive a second audio signal; and a speaker box having a first surface and a second surface, the first surface configured to accommodate at least a main audio speaker unit, and the second surface configured to accommodate at least an orientation speaker unit; wherein there is an angle between a normal line of the first surface and a normal line of the second surface.

Another aspect of the present invention provides a method for forming a virtual audio, comprising: inputting an audio signal; inputting a parameter; processing the audio signal by performing a second audio source processing program according to the parameter to generate a third signal and a fourth signal; and outputting the first signal and the second signal by two main audio speaker units respectively, and outputting the third signal and the fourth signal by two orientation speaker units respectively.

The objective, embodiments, features, and advantages of the invention will be apparent from more particular description of accompanying the drawings of the invention.

DETAILED DESCRIPTION OF THE INVENTION

The present invention discloses a system, an apparatus, and a method of speaker. The left and right audio channels respectively have a left and a right orientation speakers to output oriented high frequency audio signals, and the surrounding audio effect is enhanced. In the following the present invention can be further understood by referring to the exemplary, but not limiting, description accompanied with the drawings in FIG. 1 to FIG. 4.

Figure 1:
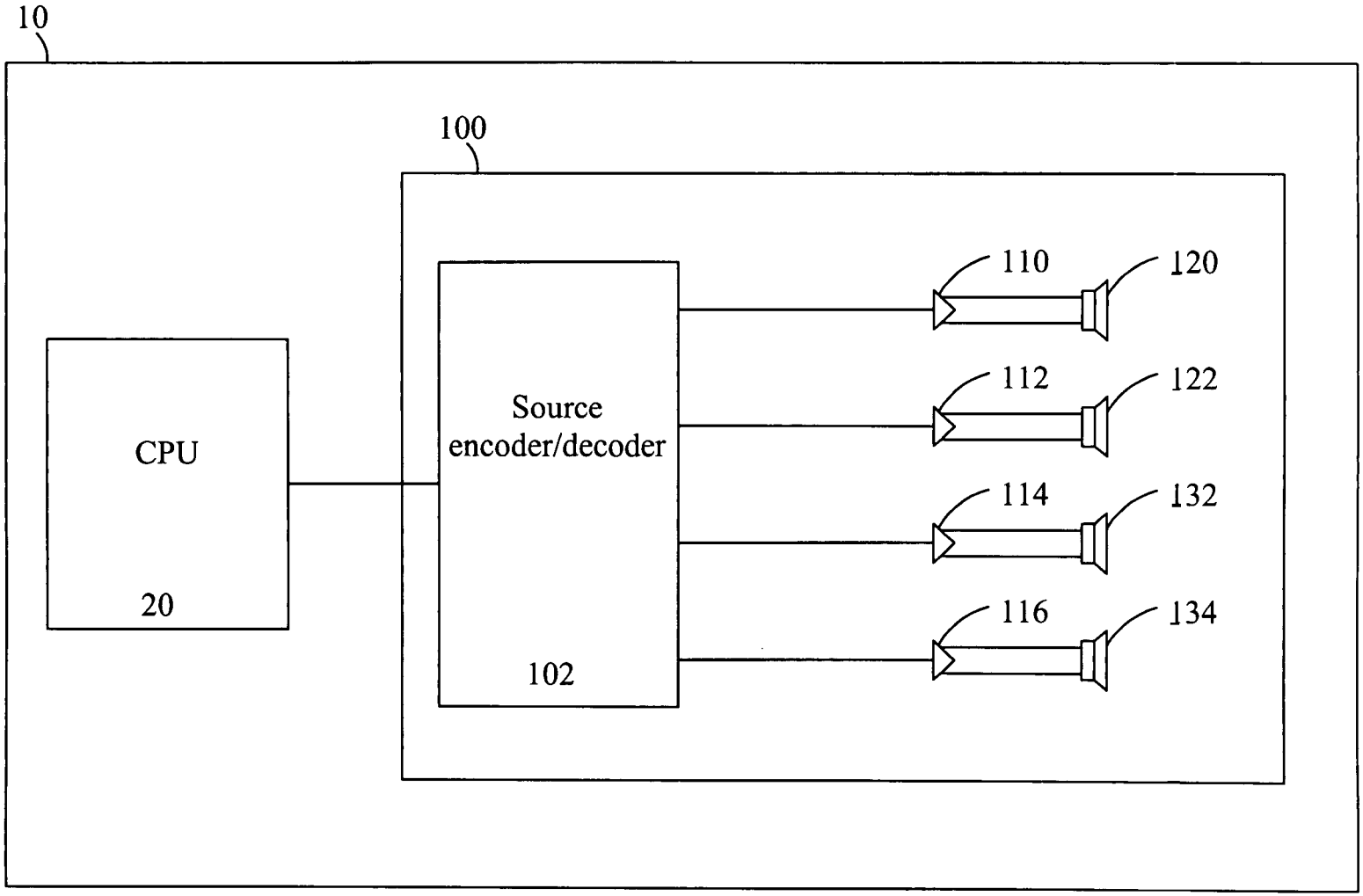
FIG. 1 shows a system block diagram of a notebook in accordance with one embodiment of the present invention.

FIG. 1 illustrates a system block diagram of a notebook in accordance with one embodiment of the present invention. In this embodiment, a notebook 10 includes a CPU 20 and a speaker system 100. The user can store data in a storage medium, such as CD, DVD, portable storage device, or any information storage media, and the data stored in the storage medium can be read by the notebook 10 and transmitted to the CPU 20 of the notebook 10 (not shown). The received data are processed by the CPU 20 to generate an audio signal, and the processed data are transmitted to the speaker system 100. It should be noticed that the notebook 10 of the present embodiment can be a television, a computer, or a multimedia device having any kinds of audio output device.

The audio signal is transmitted to the source encoder/decoder 102 by the speaker system 100, and is processed by performing a first audio source processing program and a second audio source processing program respectively. The audio signal is calculated and simulated to output the signal with the surrounding audio effect by performing the first audio source processing program, such as the Dolby Digital processing program, which is then encoded/decoded to output a first signal and a second signal. The first signal and the second signals are respectively the audio signal of a left audio channel and a right audio channel. It should be noticed that the first audio source processing program can be any program capable of simulating surrounding effect. The first signal is transmitted to the first power amplifier 110 connected between the source encoder/decoder 102 and the first main audio speaker unit 120 to be amplified. The second signal is transmitted to the second power amplifier 112 connected between the source encoder/decoder 102 and the second main audio speaker unit 122 to be amplified. The amplified first signal is output by the first main audio speaker unit 120. The amplified second signal is output by the second main audio speaker unit 122.

The second audio source processing program of the source encoder/decoder 102 is performed to process the received audio signal in accordance with the inputting parameter. The second audio source processing program is configured to filter out the audio signal with a frequency larger than a predetermined frequency, and the high frequency part of the audio signal is filtered out to respectively output a third signal and a fourth signal. The third signal and the fourth signal are audio signals of a left audio channel and a right audio channel respectively. The third signal is transmitted to the third power amplifier 114 connected between the source encoder/decoder 102 and the first orientation speaker unit 132, and to be amplified. The fourth signal is transmitted to the fourth power amplifier 116 that is connected between the source encoder/decoder 102 and the second orientation speaker unit 134 to be amplified. The amplified third signal is output by the first orientation speaker unit 132. The amplified fourth signal is output by the second orientation speaker unit 134. The directivity of the high frequency audio signals is higher than that of low frequency audio signals. The surrounding audio effect is enhanced by increasing output of the high frequency signals from the first orientation speaker 132 and the second orientation speaker unit 134.

Figure 2:
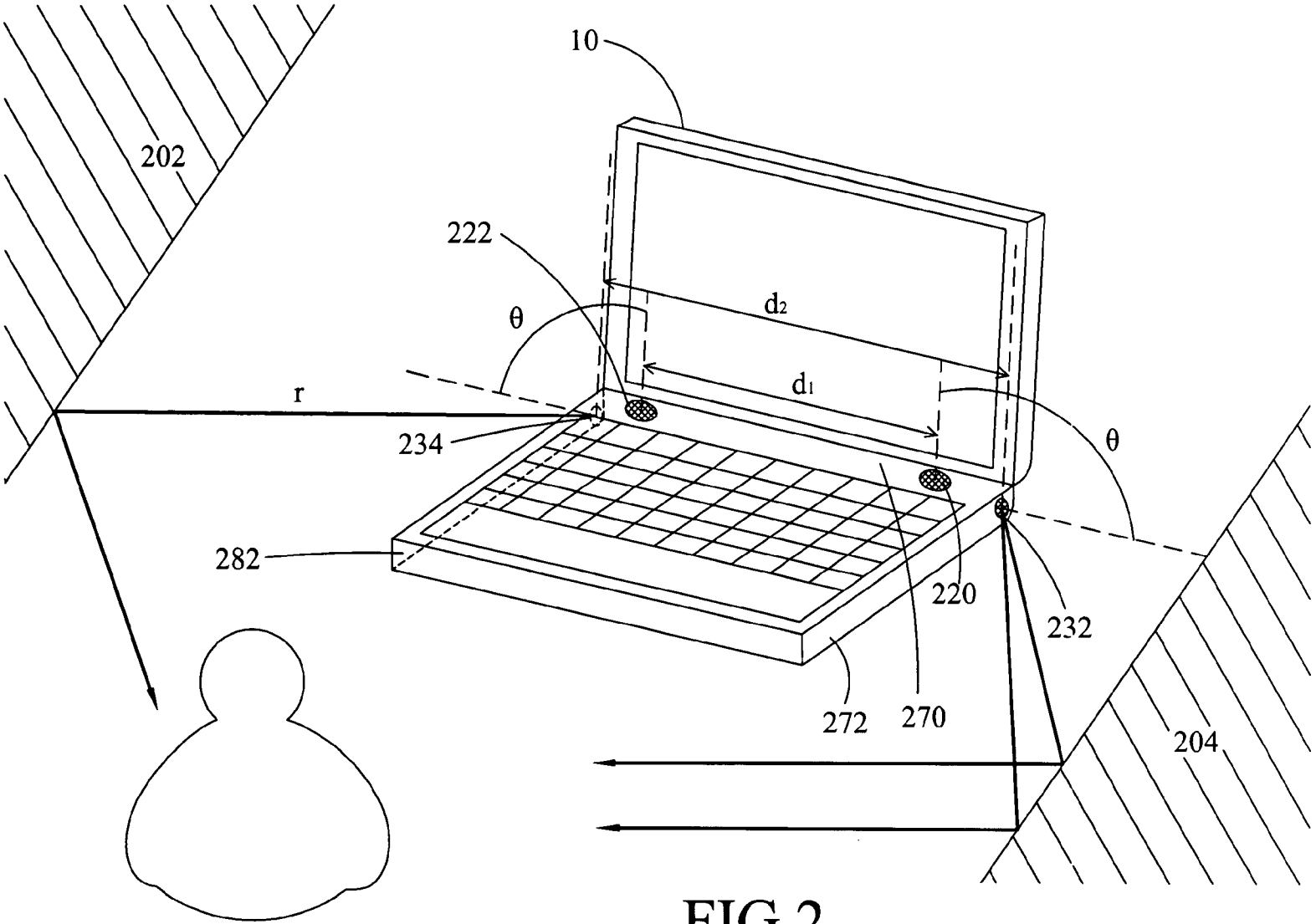
FIG. 2 shows a notebook structure diagram accommodating a main audio speaker and an orientation speaker unit in accordance with one embodiment of the present invention.

FIG. 2 shows a notebook 10 structure diagram accommodating a main audio speaker 220, 222, and an orientation speaker unit 232, 234 in accordance with one embodiment of present invention. The audio signals are output by the first main audio speaker unit 220 and the second main audio speaker unit 222, and the user can hear the complete audio signals. Besides, both the first orientation speaker 232 and second orientation speaker 234 have orientation channels. The first orientation speaker 232 and the second orientation speaker 234 are configured to output the orientation audio signal with high frequency. The user can hear the surrounding audio effect by transporting the outputting audio signals in many ways, such as direct, diffraction, refraction, and reflection transportation.

The first main speaker unit 220 and the first orientation speaker unit 232 are accommodated in a speaker box (not shown). The second main speaker unit 222 and the second orientation speaker unit 234 are accommodated in another speaker box (not shown). The speaker box includes a first surface 270, a second surface 272, and a fourth surface 282. The first surface 270 is configured to accommodate a first main audio speaker unit 220 and the second main speaker unit 222. The second surface 272 is configured to accommodate the first orientation speaker 232. The fourth surface 282 is configured to accommodate the second orientation speaker 234. The inputting parameter input into the second audio signal processing program is an angle θ between a normal line of the first surface 270 and a normal line of the second surface 272, or between the normal line of the first surface 270 and a normal line of the fourth surface 282. In this embodiment, the angle θ is 90 degree. It should be noticed that the angle θ can be any angle from 0 degree to 359 degree. Besides, in this embodiment the first main audio speaker unit 220 and the second main audio speaker unit 222 are both accommodated in the first surface 270. It should be noted that the first main audio speaker unit 220 and the second main audio speaker unit 222 are accommodated in two different surfaces.

In another embodiment, the inputting parameter is a distance, d1, between the first main audio speaker unit 220 and the second main audio speaker unit 222, or a distance, d2, between the first orientation speaker unit 232 and the second orientation speaker unit 234, as shown in FIG. 2.

In another embodiment, the inputting parameter can be an audio reflecting distance, r, between the second orientation speaker unit 234 and a reflecting object 202, as shown in FIG. 2. It should be noticed that the inputting parameter can be an audio reflecting distance between the first orientation speaker unit 232 and the reflecting object 202.

In another embodiment, referring to FIG. 2, differing from the above-mentioned embodiment, the second audio source processing program is configured to delay the audio signal by a predetermined time to output the third signal and the fourth signal respectively. There is a time difference between the third signal, the fourth signal and the first signal, the second signal. Therefore, surrounding audio effect is enhanced. It should be noticed that the phase of the audio signal can be shifted by the second audio source processing program.

Figure 3:
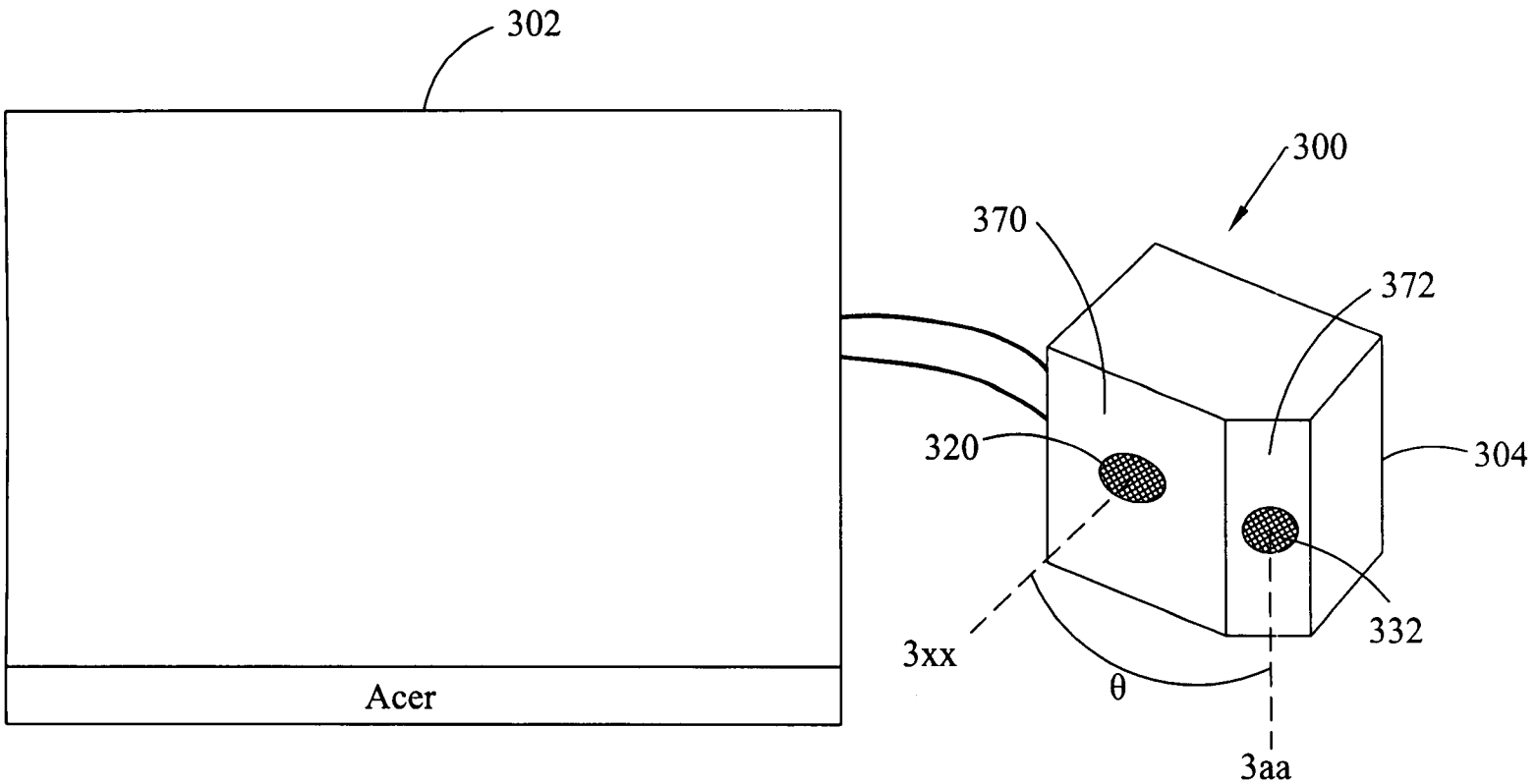
FIG. 3 illustrates a speaker device in accordance with one embodiment of the present invention.

In other embodiment, the FIG. 3 illustrates a speaker device in accordance with one embodiment of the present invention. The speaker device 300 includes a speaker box 304 having a first surface 370 and a second surface 372. The main audio speaker unit 320 and the orientation speaker unit 332 are respectively accommodated in the first surface 370 and the second surface 372. There is an angle θ between a normal line 3*xx* of the first surface 370 and a normal line 3*aa* of the second surface 372. A first audio signal, including a full-frequency range signal from high frequency to low frequency, and a second audio signal, being filtered to be an oriented high frequency audio signal are generated by a television 302 and transmitted to a speaker device 300. Then, the first audio signal is output by the main audio speaker unit 320, and the second audio signal is output by the orientation speaker unit 332. It should be noticed that this embodiment includes at least a main speaker unit 320 and at least an orientation speaker unit 332. However, those skilled in the art will understand that the speaker device 300 may include two or more main audio speaker unit and two or more orientation speaker unit.

In this embodiment, the user hears the complete audio signal output by the main audio speaker unit 320. In the same time, the user hears the high frequency audio signal with the orientation audio effect output by the orientation speaker unit 332. The user can hear the surrounding audio effect by transporting the outputting audio signal in many ways, such as direct, diffraction, refraction, and reflection transportation. It should be noticed that the speaker device 300 doesn't perform any audio process, such as delaying the audio signal by a predetermined time, filtering out the audio signal with a predetermined frequency. The processed audio signal is processed by the source encoder/decoder of the television 302 (not shown).

Figure 4:
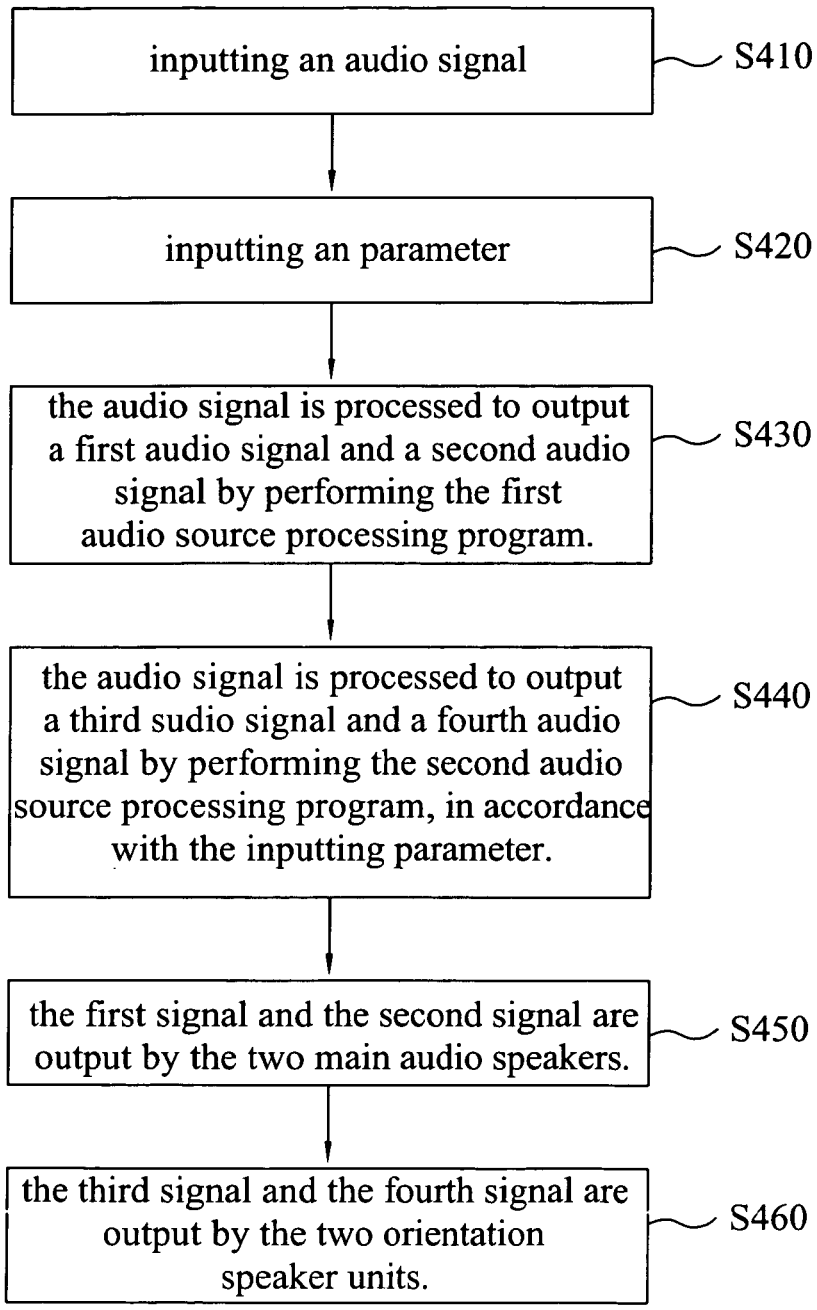
FIG. 4 illustrates a flowchart of a method for forming a virtual audio in accordance with one embodiment of the present invention.

In another embodiment, FIG. 4 illustrates a flowchart of a method for forming a virtual audio in accordance with one embodiment of present invention. The method for forming a virtual audio includes the following steps. In step S410, the audio signal, which is a full-frequency range signal, is input. It should be noticed that the audio signal can be stored in storage media, such as CD, DVD, and a portable storage device. The audio signal is the audio signal read from the storage media or received from a multimedia device, such as the audio signal output from television or the signal processed by the computer. In step S420, a parameter is input to the second audio source processing program. A speaker box having two surfaces are configured to accommodate the main audio speaker unit and the orientation speaker unit respectively. A parameter can be an angle between a normal line of a surface of the main audio speaker unit and a normal line of a surface of orientation speaker unit, or a distance between the two main audio speaker units and between the two orientation speaker units, and a distance between the orientation speaker unit and a reflecting object.

In the step S430, the received audio signal is calculated and simulated to output a first audio signal and a second audio signal with the surrounding audio effect by performing the first audio source processing program, such as the Dolby Digital processing program. The first audio source processing program is Dolby Digital processing program. It should be noticed that the first audio source processing program can be any program capable of simulating surrounding effect. In step S440, the intensity, the frequency, and the phase of the audio signal are calculated to mix a new orientation audio signal, in accordance with the parameter input by the user. The audio signal with a frequency larger than a predetermined frequency is filtered out by the second audio source processing program to generate the third signal and the fourth signal. The third signal and the fourth signal are high frequency signals with orientation property.

In step S450, the first signal and the second signal are respectively output by the two main audio speakers. In step S460, the third signal and the fourth signal (i.e. the orientation audio signal) are separately output by the two orientation speaker units. The user can hear the surrounding audio effect by transporting the outputting audio signal in many ways, such as direct, diffraction, refraction, and reflection transportation, since the high frequency audio signal are more directional than the low frequency audio signal.

In another embodiment, in the step S440, differing from the above mentioned embodiment, the audio signal is delayed by a predetermined time to output the third signal and the fourth signal respectively. Therefore, there is a time difference between the third signal, the fourth signal and the first signal, the second signal, and the surrounding audio effect is enhanced. It should be noticed that the phase of the audio signal can be shifted by the second audio source processing program.

Although the specific embodiments of the present invention have been illustrated and described, it is to be understood that the invention is not limited to those embodiments. One skilled in the art may make various modifications without departing from the scope or spirit of the invention.

What is claimed is:

1. A speaker system, comprising:

a source encoder/decoder for receiving an audio signal, performing a first audio source processing program and an encoding/decoding process on the audio signal to output a first signal and a second signal, and performing a second audio source processing program to filter out the audio signal with a frequency larger than a predetermined frequency to output a third signal and a fourth signal according to an inputting parameter;

a first main audio speaker unit and a second main audio speaker unit, for receiving the first signal and the second signal respectively;

a first orientation speaker unit and a second orientation speaker unit, for receiving the third signal and the fourth signal respectively, the first and second orientation speaker units being high frequency speaker units; and first and second power amplifiers, wherein the third signal is transmitted to the first orientation speaker unit from the source encoder/decoder through the first power amplifier and the fourth signal is transmitted to the second orientation speaker unit from the source encoder/decoder through the second power amplifier.

2. The speaker system of claim 1, wherein the first audio source processing program is a Dolby Digital audio processing program.

3. The speaker system of claim 1, further comprising a speaker box having a first surface, a second surface, a third surface, and a fourth surface, the first surface configured to accommodate a first main audio speaker unit, the second surface configured to accommodate a first orientation speaker unit, the third surface configured to accommodate the second main audio speaker unit, and the fourth surface configured to accommodate the second orientation speaker unit, wherein the inputting parameter is an angle between a normal line of the first surface and a normal line of the second surface, or between a normal line of the third surface and a normal line of the fourth surface.

4. The speaker system of claim 1, wherein the inputting parameter is a distance between the first main audio speaker unit and the second main audio speaker unit, or a distance between the first orientation speaker unit and the second orientation speaker unit.

5. The speaker system of claim 1, wherein the inputting parameter is an audio reflecting distance between the first orientation speaker unit and a reflecting object, or between the second orientation speaker unit and a reflecting object.

6. The speaker system of claim 1, wherein the second audio source processing program is configured to delay the audio signal by a predetermined time.

7. The speaker system of claim 1, further comprising a third power amplifier, and a fourth power amplifier, wherein the third power amplifier and the fourth power amplifier are respectively connected between the source encoder/decoder and the first main audio speaker unit and between the source encoder/decoder and the second main audio speaker unit.

8. The speaker system of claim 1, further comprising a central processor unit (CPU) configured to receive an inputting data to generate the audio signal.

9. A speaker device, comprising:

at least a main audio speaker unit configured to receive a first audio signal;

at least an orientation speaker unit configured to receive a second audio signal, wherein the second audio signal is a high frequency signal filtered out according to an inputting parameter; and a speaker box having a first surface and a second surface, the first surface configured to accommodate at least a main audio speaker unit, and the second surface configured to accommodate at least an orientation speaker unit, wherein there is an angle between a normal line of the first surface and a normal line of the second surface, and the at least one orientation speaker unit is a high frequency speaker unit that includes a power amplifier configured to amplify the second audio signal.

10. The speaker device of claim 9, wherein the angle is 90 degree.

11. The speaker device of claim 9, wherein the first audio signal is a full-frequency range signal.

12. A method for forming a virtual audio, comprising:

inputting an audio signal;

inputting a parameter;

processing the audio signal by performing a second audio source processing program according to the parameter to filter out the audio signal with a frequency larger than a predetermined frequency to generate a third signal and a fourth signal; and outputting the first signal and the second signal by two main audio speaker units respectively, and outputting the third signal and the fourth signal by two orientation speaker units respectively, the two orientation speaker units being high frequency speaker units, wherein the step of processing the third and fourth signals includes amplifying the third and fourth signals before outputting the third and fourth signals via the two orientation speaker units respectively.

13. The speaker method of claim 12, wherein the first audio source processing program is a Dolby Digital audio processing program.

14. The speaker method of claim 12, further comprising a speaker box having two surfaces, the two surfaces configured to accommodate the main audio speaker unit and the orientation speaker unit respectively, wherein the parameter is an angle between a normal line of the main audio speaker unit and a normal line of the orientation speaker unit.

15. The speaker method of claim 12, wherein the parameter is a distance between the two main audio speaker unit or a distance between the two orientation speaker units.

16. The speaker method of claim 12, wherein the parameter is an audio reflecting distance between the orientation speaker unit and a reflecting object.

17. The speaker method of claim 12, wherein the second audio source processing program is configured to configured to delay the audio signal by a predetermined time.

18. The speaker method of claim 12, further comprises an audio signal generating step configured to process an inputting data to generate the audio signal.

19. The speaker method of claim 12, wherein the audio signal is a full-frequency range signal.

* * * * *